United States Patent [19]

Backlund

[11] Patent Number: 4,609,068

[45] Date of Patent: Sep. 2, 1986

[54] EXHAUST ACCESSORY UNIT FOR INTERNAL COMBUSTION ENGINES

[76] Inventor: Drew Backlund, 1621 E. 27th, Spokane, Wash. 99203

[21] Appl. No.: 760,352

[22] Filed: Jul. 29, 1985

[51] Int. Cl.[4] ..... F01N 1/08

[52] U.S. Cl. ..... 181/226; 181/237; 181/278

[58] Field of Search ..... 181/226, 236, 237, 241, 181/254, 277, 278

[56] References Cited

U.S. PATENT DOCUMENTS

| | | | |
|---|---|---|---|
| 810,542 | 1/1906 | Kahlenberg | 181/254 |
| 1,375,621 | 4/1921 | Wright, Jr. | 181/236 |
| 2,072,372 | 3/1937 | Kingsley | 181/254 X |
| 2,960,178 | 11/1960 | De Lorean | 181/238 |
| 3,391,756 | 7/1968 | Larkfeldt et al. | 181/226 |

*Primary Examiner*—Benjamin R. Fuller
*Attorney, Agent, or Firm*—Wells, St. John & Roberts

[57] ABSTRACT

An engine exhaust accessory unit comprises a tubular housing adapted to be fitted over the end of an exhaust header. The outer end of the tubular housing is partially obstructed by a pivotable rigid perforated plate. The plate is pivotally mounted about a transverse axis offset below the central longitudinal axis of the housing. The larger upper section of the plate causes it to swing outward in response to passage of exhaust gases through the housing. The perforated plate automatically modifies engine noises and varies exhaust back pressure as a function of its angular position about the transverse axis. A yieldable spring biases the plate to a perpendicular position across the housing, and resists pivotal movement of the butterfly plate in response to passage of exhaust gases. Stops in the path of movement of the plate limit its movement between a perpendicular position across the housing and a position parallel to the longitudinal central housing axis.

17 Claims, 6 Drawing Figures

EXHAUST ACCESSORY UNIT FOR INTERNAL COMBUSTION ENGINES

FIELD OF THE INVENTION

This disclosure relates to an accessory unit adapted to be mounted to the exhaust header of an internal combustion engine for reducing exhaust noise levels and improving low speed engine performance. It serves both as a muffler and as a variable exhaust pressure control.

BACKGROUND OF THE INVENTION

The apparatus disclosed herein was developed to reduce the low speed exhaust noise levels produced by high performance internal combustion engines, while maintaining and improving engine performance levels in lower speed ranges without affecting engine performance at the high speeds for which such engines are designed.

High performance internal combustion engines are utilized in boats, automobiles, trucks, off-road vehicles, motorcycles and other vehicles for recreational and sports usage. Because such engines operate at top speed with greatest efficiency and power when exhaust back pressure is at a minimum, they are typically provided with large open exhaust headers that serve as expansion chambers for the hot exhaust gases. These headers are open to the atmosphere without restrictions that would increase back pressure.

Such engines can be effectively (and legally) operated in some remote areas, where noise levels of engine operation are either not regulated or are environmentally acceptable. However, such areas are becoming more rare as people in increasing numbers have sought recreational and sports activities in more remote and rural areas.

Noise and engine power are closely related, particularly in the minds of enthusiasts owning and operating vehicles powered by large displacement high performance engines. It has been observed that those operating such engines often attempt to emphasize vehicle performance by a high level of intake and exhaust noise. Noise is as often a substitution for speed as a by-product of it. The explanation for the exhilaration provided by high noise levels is that much of the appeal of owning or operating a fast car, motorcycle, or boat is the joy of being noticed. One way to assure such notoriety is to operate a vehicle at such a high noise level that those about the area are forced to take notice of it.

As the numbers of high performance vehicles has increased, the public's tolerance for such noise levels has decreased. Current concern for environmental factors includes concern about noise levels and the effect of noise on quality of life. It has therefore become imperative that operators of vehicles powered by high performance engines modify the engines to make their performance more compatible with current environmental standards.

Most sound-reduction systems result in increased exhaust system restriction and reduced power. Such systems typically involve the use of a muffler or sound disperser. They involve convoluted exhaust paths, baffles and other restrictions which deviate from the unimpeded expansion of exhaust gas necessary for highest engine performance.

As a compromise, many noise reduction systems utilize a "bypass" or "cutout" system. A valve or diverter within the exhaust pipe is manually or automatically operated to allow the user of the engine to mechanically select either straight-through exhaust routing or a path that goes through a noise reduction mechanism. This allows dampening of sound in noise-restricted areas, and straight-through power and sound in open areas where sound restrictions are not encountered. However, such systems are not variable in nature—the bypass is either operative or inoperative at any given stage of engine operation. These systems are also relatively expensive, due to the mechanical linkages and controls required in order to effectively operate such a valve, plus the dual nature of the noise reduction system which must be added to the usual headers. The systems are typically manually operated, and therefore noise reduction is achieved essentially at the whim and control of the engine operator.

The present invention provides automatically varying noise reduction. It results in full noise reduction at idle and low speed engine operation, and essentially unrestricted exhaust flow at high speed engine operation. This variable mode of achieving engine noise reduction is particularly applicable to boats incorporating high peformance internal combustion engines. It has been found that the most controversial problem in the operation of such boats is the high level of noise which they generate while near the dock area or shoreline, particularly as the boats are headed directly out from the shoreline with their exhausts directed rearwardly at those on shore. By providing maximum sound abatement at low speed engine operation, the present invention dramatically reduces the amount of noise projected to shore during initial boat operation. At the same time, the device automatically opens the exhaust outlets during high speed operation of the boat, which typically takes place at a substantial distance from shore. At such times the boat is less likely to be projecting its exhaust noises directly rearward to an identifiable dock or shore area.

BRIEF DESCRIPTION OF THE DRAWINGS

The invention is illustrated in the accompanying drawings, in which.

DETAILED DESCRIPTION OF THE PREFERRED EMBODIMENT

Figure 1:
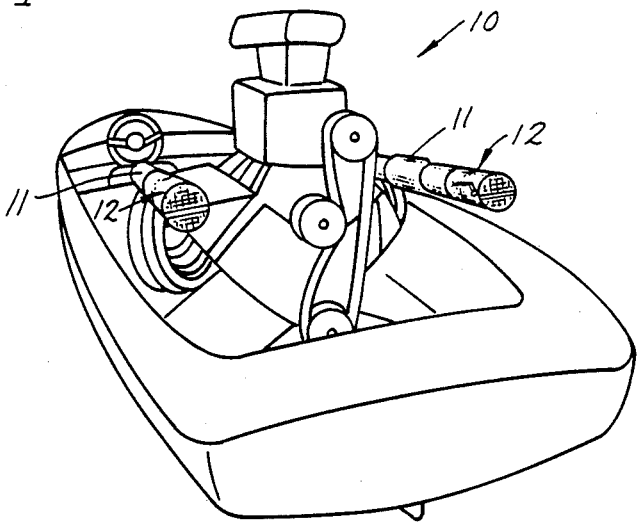
FIG. 1 is a rear perspective view of a high performance boat having an engine equipped with two exhaust accessory units.

In compliance with the constitutional purpose of the Patent Laws "to promote the progress of science and useful arts" (Article 1, Section 8), applicant submits the following disclosure of the invention.

The exhaust accessory unit 12 shown in the drawings automatically controls proper back pressure in the exhaust system for a high performance engine of the type conventionally operated without mufflers or other exhaust restrictions. By controlling back pressure, it achieves greater torque and horsepower when the engine is operated at low and mid-range speeds. It automatically matches exhaust flow to intake flow. It is fully automatic in operation, but can be pre-adjusted to match the performance requirements of a given engine.

Figure 6:
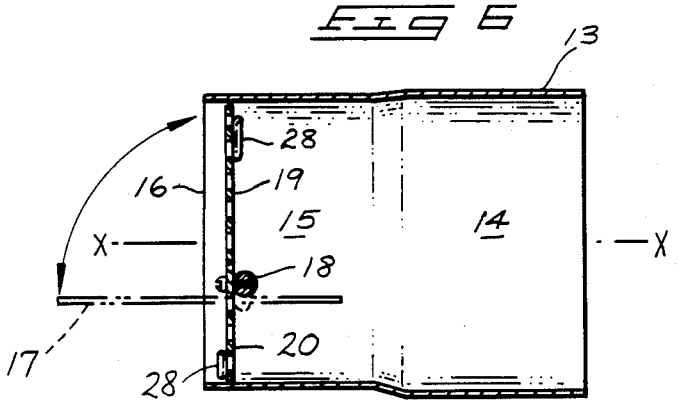
FIG. 6 is a sectional view taken along line 6—6 in FIG. 5.

The unit 12 includes a tubular housing 13 formed about a central longitudinal axis (shown as X—X in FIG. 6). Housing 13 has an inner end 14 adapted to be coaxially mounted to an exhaust outlet of an internal combustion engine. FIG. 1 generally illustrates a high performance boat engine 10 having two rearwardly protruding exhaust headers 11 on which a pair of the exhaust accessory units are mounted.

Figure 2:
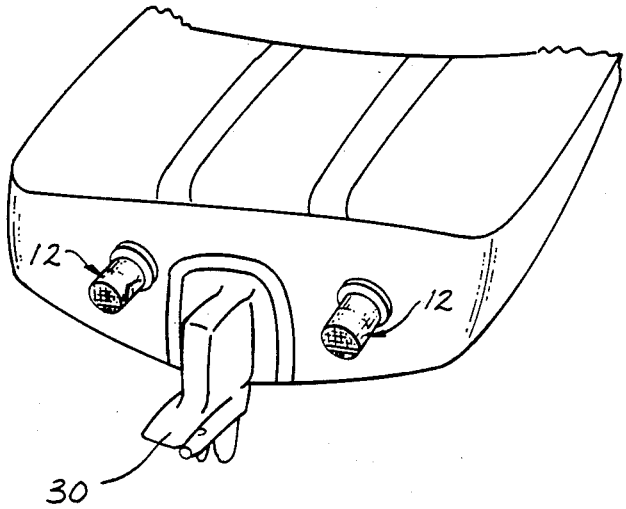
FIG. 2 is a fragmentary rear perspective view showing installation of the units on transom exhaust ports.
Figure 3:
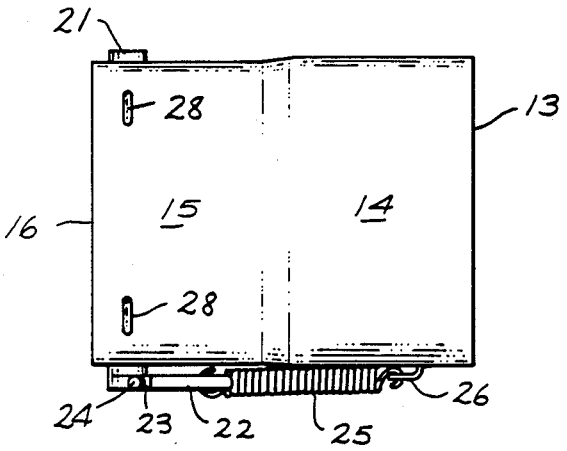
FIG. 3 is a top view of an exhaust accessory unit.
Figure 4:
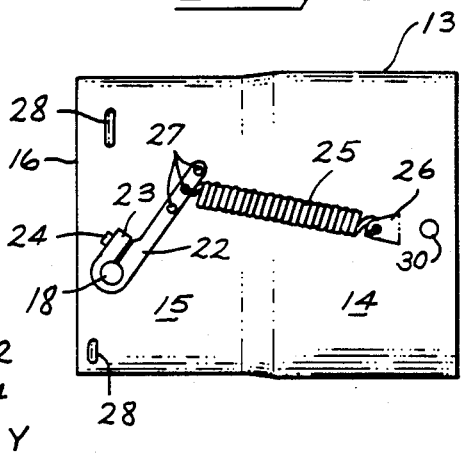
FIG. 4 is a side view.
Figure 5:
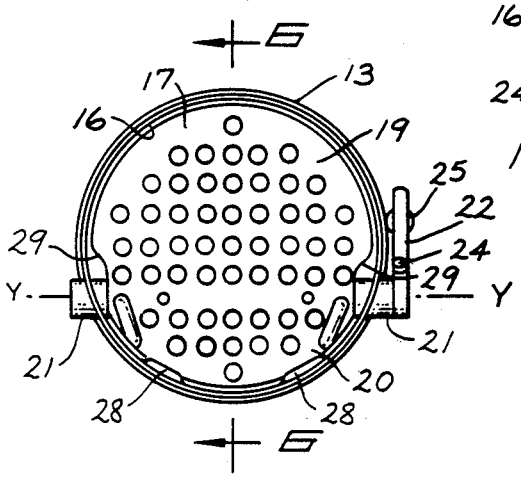
FIG. 5 is an end view.

FIG. 2 illustrates use of the exhaust accessory units on headers projected through a boat transom. The units 12 are similarly mounted to the conventional outer ends of the engine exhaust headers at each side of a transom drive unit shown at 30.

Structural details of the accessory unit 12 are best understood from the showings of FIGS. 3 through 6. The tubular housing 13 is longitudinally divided into a belled inner end 14 and a cylindrical outer end 15. The inside diameter of the outer end 15 should match the inside diameter of the header on which the unit 12 is to be mounted. Housing 13 terminates along an outer edge 16, which preferably lies in a plane perpendicular to the longitudinal central axis X—X. The inside diameter of the inner end 14 of housing 13 should substantially match the outside header diameter so that it can be frictionally engaged on the header when slipped over its open end.

A rigid perforated butterfly plate 17 is pivotally mounted across the housing 13 about a transverse axis offset from the central longitudinal axis X—X. The pivotal axis is shown at line Y—Y in FIG. 5. When properly installed on a header, the transverse axis Y—Y is located under the horizontal plane containing longitudinal axis X—X.

The perforated butterfly plate 17 is supported on a pivot shaft 18 rigidly joined to it and centered along the transverse axis Y—Y. The plate 17 is divided by shaft 18 and axis Y—Y into an upper or major section 19 and a lower or minor section 20. The area about section 19 is substantially greater than the area about section 20. Both areas are perforated by a plurality of rows of small circular apertures. The major and minor sections 19 and 20 have proportional amounts of solid and perforated areas located to each side of the transverse axis Y—Y. Since the solid areas in the sections 19, 20 are proportional to their respective sizes, the impingement of flowing exhaust gases against the inner surfaces of these sections will result in the major section 19 being pushed outwardly about the axis Y—Y.

A control arm 22 and spring 25 on each unit 12 serves as yieldable means for biasing the butterfly plate 17 to a transverse position extending across the open end of tubular housing 13. They permit the butterfly plate 17 to pivot about axis Y—Y to an open horizontal position (shown in dashed lines in FIG. 6), in which the plate lies substantially parallel to the longitudinal axis X—X.

The units 12 are typically paired, in left and right hand models as seen in FIGS. 1 and 2. Each has a control arm 22 and spring 25, which preferably face inward. Each unit 12 is held in place by a bolt assembly fastened through an aperture 30 formed through the walls of the unit 12 and an aligned aperture in header 11 to prevent movement of the units 12 relative to the engine.

The butterfly plate 17 is biased to urge the major section 19 inwardly about axis Y—Y by the control arm 22 and tension spring 25. Control arm 22 is located outwardly adjacent to one of the shaft bearings 21 that support the pivot shaft 18 at each side of housing 13. Arm 22 includes a split base 23 selectively locked about the outer end of shaft 18 by a manually adjustable locking screw 24. Spring 25 is stretched between an aperture 27 along control arm 22 to a spring perch 26 bent from the belled inner end 14 of tubular housing 13.

First stop means for limiting inward pivotal motion of the major section 19 of butterfly plate 17 is presented by a series of indented ribs 28 which project inwardly from the inner surface of tubular housing 13 in the path of pivotal movement of butterfly plate 17. As shown, the lower ribs 28 are engageable by the outer surface of plate 17 along the periphery of minor section 20, while the upper ribs 28 are engageable with the inner surface of plate 17 about the periphery of major section 19.

Second stop means is provided on the unit for limiting outward movement of the major section 19 to an angular position wherein butterfly plate 17 is substantially parallel to the central longitudinal axis shown at X—X in FIG. 6. This outward pivotal movement is limited by engagement of peripheral recesses 29 formed on plate 17 adjacent to the respective shaft bearings 21. The peripheral recesses 29 are adapted to abut the outer edge 16 of tubular housing 13 when the butterfly plate 17 is in a substantially horizontal orientation about the transverse axis Y—Y. This interference between plate 17 and edge 16 occurs because the chord across tubular housing 13 along the axis Y—Y is less than the peripheral diameter across plate 17.

When mounted on a header, as shown in FIGS. 1 and 2, each accessory unit 12 is normally closed by the spring-biased butterfly plate 17. When properly adjusted, plate 17 remains closed, or substantially closed, during start-up and idling of the engine on which it is mounted. However, as the flow of exhaust gases increases in response to increased engine intake, the pressure on the butterfly plate 17 will gradually swing it from a vertical position to a horizontal position.

At idling speeds the perpendicular position of butterfly plate 17 across the tubular housing 13 will cause exhaust gases to flow through the perforated restrictions, thereby substantially muffling the noise projected to the rear of the engine. In addition, the exhaust restrictions provided by the perpendicular butterfly plate will increase exhaust back pressure on the engine, thereby improving engine operation at low speeds, where high performance engines typically operate rather unevenly. When the engine is opened at full throttle, the plate 17 will approach a horizontal position, where no substantial back pressure is exerted on the engine by utilization of the exhaust accessory unit 12. The use of the unit 12 therefore does not affect engine operation at full throttle.

The automatic variation of engine exhaust back pressure can be preset to specific engine requirements by a series of available adjustments which will vary operation of butterfly plate 17. First, different springs can be utilized between housing 13 and control arm 22, depending upon the required resistance to pivotal movement of plate 17. Secondly, the moment arm of the spring can be varied by selection of a suitable spring aperture 27 along control arm 22. Finally, the angular position of control arm 22 relative to the angular position of butterfly plate 17 about axis Y—Y can be varied by releasing and positioning control arm 22 on pivot shaft 18. This is accomplished by adjusting the split base 23 of control arm 22 and subsequently locking it at the desired position by use of locking screw 24. The angular position of control arm 22 relative to plate 17 controls the sinusoidal variations in control arm torque exerted by spring 25 through the 90° pivotal movement of butterfly plate 17 about axis Y—Y.

This apparatus provides an effective answer to the need for noise control of high performance engines at low and idle operating speeds, while assuring full torque and horsepower at cruising or high speed operation of the engine. It provides measurable reduction in noise to the rear of the engine whenever butterfly plate 17 is fully or partially projecting across the path of the exiting exhaust gases. Furthermore, since the major section 19 of butterfly plate 17 is arranged above the minor section 20, engine exhaust noises are deflected upwardly, thereby reducing the noise impact on observers located at the elevation of engine operation.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications with the proper scope of the appended claims, appropriately interpreted in accordance with the doctrine of equivalents.

I claim:

1. An exhaust accessory unit adapted to be mounted to the exhaust header of an internal combustion engine for reducing exhaust noise levels and improving low speed engine performance, comprising:

a tubular housing formed about a central longitudinal axis, said housing having an open inner end adapted to be coaxially mounted to an exhaust outlet of an internal combustion engine and an open outer end;

a rigid perforated butterfly plate pivotally mounted across the housing about a transverse axis radially offset from said central longitudinal axis; and yieldable means mounted between the housing and perforated plate yieldably biasing the plate to a transverse position extending across said tubular housing for allowing the plate to progressively pivot between the transverse position and an open position substantially parallel with the longitudinal axis in response to the pressure of exhaust gases passing through said axial exhaust passageway such that when the engine is operating at high speed, the plate is situated in the open position, permitting free passage of exhaust gases through said housing and such that when the engine is operating at progressively lower speeds, the plate progressively moves to the transverse position, restricting exhaust flow through the housing, and abating noise emitted therefrom.

2. The exhaust accessory unit as claimed by claim 1 wherein the tubular housing has a cylindrical inner wall;

said butterfly plate having a circular outer periphery having a radius substantially equal to the radius of the cylindrical inner wall with respect to said central longitudinal axis.

3. The exhaust accessory unit as claimed by claim 1 wherein the butterfly plate is divided into major and minor sections at the respective sides of said transverse axis;

the exhaust accessory unit further comprising:

stop means limiting inward movement of the major section of the butterfly plate to a position substantially perpendicular to said central longitudinal axis.

4. The exhaust accessory unit as claimed by claim 1 wherein the tubular housing has an inner wall extending between the open inner and outward ends thereof; cylindrical inner wall;

said butterfly plate having an outer periphery complementary to the inner wall with respect to said central longitudinal axis;

said butterfly plate being divided into major and minor sections at the respective sides of said transverse axis;

said exhaust accessory unit further comprising:

stop means limiting inward movement of the major section of the butterfly plate to a position substantially perpendicular to said central longitudinal axis.

5. The exhaust accessory unit as claimed by claim 1 wherein said yieldable means is comprised of:

crank arm means having an end mounted to the butterfly plate along the transverse axis for pivotably moving said butterfly plate about the transverse axis in response to axial forces applied thereto at a point spaced from said transverse axis;

biasing means interconnecting the crank arm and housing for yieldably urging the crank arm and butterfly plate to said transverse position; and adjustment means for selectively varying yieldable biasing forces of said biasing means.

6. The exhaust accessory unit as claimed by claim 5 wherein said biasing means is comprised of:

a spring having one end mounted to the housing and the remaining end mounted to said crank arm;

wherein said adjustment means is comprised of a series of mounting points along the crank arm at varying radial distances from the transverse axis and adapted to selectively mount said remaining spring end.

7. The exhaust accessory unit as claimed by claim 5 wherein said adjustment means is comprised of:

means mounting said crank arm to said plate for selective angular adjustment about said transverse axis in relation to the transverse position of said plate.

8. An exhaust accessory unit adapted to be mounted to the exhaust header of an internal combustion engine for reducing exhaust noise levels and improving low speed engine performance, comprising:

a tubular housing formed about a central longitudinal axis, said housing having an inner end adapted to be mounted to an exhaust outlet of an internal combustion engine, and having an open outer end;

a rigid butterfly plate pivotally mounted within the housing about a transverse axis offset from said central longitudinal axis, said transverse axis dividing the butterfly plate into major and minor sections said plate having solid and perforated areas to each side of the transverse axis;

first stop means on said housing in the path of said butterfly plate for limiting inward pivotal movement of its major section to a position substantially perpendicular to said central longitudinal axis;

second stop means on said housing in the path of said butterfly plate for limiting outward pivotal motion of its major section to a position substantially parallel to said central longitudinal axis;

and yieldable means operably connected between said housing and said butterfly plate for biasing the butterfly plate against said first stop means and yieldably resisting pivotal motion of said butterfly plate toward said second stop means in response to flow of engine exhaust gases through said housing.

9. The exhaust accessory unit as claimed by claim 8 wherein said yieldable means is comprised of:

crank arm means having an end mounted to the butterfly plate along the transverse axis for pivotably moving said butterfly plate about the transverse axis in response to axial forces applied thereto at a point spaced from said transverse axis;

biasing means interconnecting the crank arm and housing for yieldably urging the crank arm and butterfly plate to said transverse position; and adjustment means for selectively varying yieldable biasing forces of said biasing means.

10. The exhaust accessory unit as claimed by claim 9 wherein said adjustment means is comprised of:

means mounting said crank arm to said plate for selective angular adjustment about said transverse axis in relation to the transverse position of said plate.

11. The exhaust accessory unit as claimed by claim 8 wherein said biasing means is comprised of:

a spring having one end mounted to the housing and the remaining end mounted to said crank arm;

wherein said adjustment means is comprised of a series of mounting points along the crank arm at varying radial distances from the transverse axis and adapted to selectively mount said remaining spring end.

12. The exhaust accessory unit as claimed by claim 8 where said second stop means is comprised of an abutment formed on the butterfly plate adjacent to said transverse axis and positioned thereon to pivot into abutment with said housing as said plate pivots to said position substantially parallel to said central longitudinal axis.

13. An exhaust header adapted to be mounted to the exhaust ports of an internal combustion engine for reducing noise levels and improving low speed engine performance, comprising:

a tubular housing formed about a central longitudinal axis, said housing having an inner end adapted to be coaxially mounted to an exhaust outlet of an internal combustion engine;

a rigid perforated butterfly plate pivotally mounted across the housing about a transverse axis offset from said central longitudinal axis;

yieldable means for biasing the plate to a transverse position extending across said tubular housing;

wherein said tubular housing has an inner wall;

said butterfly plate having an outer periphery complementary to the inner wall with respect to said longitudinal axis;

said butterfly plate being divided into major and minor sections at respective sides of said transverse axis; and stop means limiting inward movement of the major section of the butterfly plate to a position substantially perpendicular to said longitudinal axis.

14. The exhaust header as claimed by claim 13 wherein said yieldable means is comprised of:

crank arm means having an end mounted to the butterfly plate along the transverse axis for pivotably moving said butterfly plate about the transverse axis in response to axial forces applied thereto at a point spaced from said transverse axis;

biasing means interconnecting the crank arm and housing for yieldably urging the crank arm and butterfly plate to said transverse position; and adjustment means for selectively varying yieldable biasing forces of said biasing means.

15. The exhaust header as claimed by claim 14 wherein said biasing means is comprised of:

a spring having one end mounted to the housing and the remaining end mounted to said crank arm;

wherein said adjustment means is comprised of a series of mounting points along the crank arm at varying radial distances from the transverse axis and adapted to selectively mount said remaining spring end.

16. The exhaust header as claimed by claim 14 wherein said adjustment means is comprised of:

means mounting said crank arm to said plate for selective angular adjustment about said transverse axis in relation to the transverse position of said plate.

17. The exhaust header as claimed by claim 16 wherein said biasing means is comprised of an elongated coil spring having one end mounted to the housing and a remaining end mounted to said crank arm, and wherein said adjustment means is comprised of:

a series of mounting points along said crank arm at positions radially spaced from the transverse axis, said points being adapted to selectively mount the remaining end of said elongated coil spring; and means mounting said crank arm to said plate for selective angular adjustment about said transverse axis in relation to the transverse position of said plate.

* * * * *